US006050200A

United States Patent [19]

Sullins et al.

[11] Patent Number: 6,050,200

[45] Date of Patent: Apr. 18, 2000

[54] LAP DESK WITH EXTERNAL TRAYS AND HINGED TOP

[75] Inventors: Patrick H. Sullins; Robert D. Sullins, both of Arlington, Tex.

[73] Assignee: Creative Manufacturing, Inc., Arlington, Tex.

[21] Appl. No.: 09/193,302

[22] Filed: Nov. 17, 1998

[51] Int. Cl.[7] ..... A47B 23/00

[52] U.S. Cl. ..... 108/43; 108/25

[58] Field of Search ..... 108/25, 26, 43, 108/152; 224/153, 628, 629, 630, 621; 206/557; 190/110, 109

[56] References Cited

U.S. PATENT DOCUMENTS

| | | | |
|---|---|---|---|
| D. 286,894 | 11/1986 | Haas et al. . | |
| D. 298,955 | 12/1988 | Zovar . | |
| D. 331,076 | 11/1992 | Montgomery . | |
| D. 333,161 | 2/1993 | Hartnett . | |
| D. 346,701 | 5/1994 | Colley, III . | |
| D. 353,623 | 12/1994 | Jones et al. . | |
| D. 358,270 | 5/1995 | Diamond . | |
| D. 359,399 | 6/1995 | Rath . | |
| D. 362,565 | 9/1995 | Tubbs et al. . | |
| D. 376,948 | 12/1996 | Sullins et al. . | |
| D. 388,463 | 12/1997 | Sullins et al. . | |
| 1,364,022 | 12/1920 | Bauer . | |
| 1,460,502 | 7/1923 | Rudesill . | |
| 1,928,806 | 10/1933 | Barcalo . | |
| 2,705,522 | 1/1955 | Kamborian . | |
| 2,707,141 | 4/1955 | Witter | 108/26 |
| 2,946,604 | 7/1960 | Hunger et al. . | |
| 2,955,972 | 10/1960 | Wintermute et al. . | |
| 3,146,143 | 8/1964 | Bolesky et al. . | |
| 3,318,636 | 5/1967 | Callum . | |
| 3,407,757 | 10/1968 | Warner . | |
| 3,661,684 | 5/1972 | Rallis et al. . | |
| 4,035,458 | 7/1977 | Lyman . | |
| 4,052,944 | 10/1977 | Jennings . | |
| 4,099,278 | 7/1978 | Parisi . | |
| 4,114,213 | 9/1978 | Beernaerts et al. . | |
| 4,229,847 | 10/1980 | Degen . | |
| 4,428,479 | 1/1984 | Shirako et al. . | |
| 4,513,974 | 4/1985 | Lin . | |
| 4,537,646 | 8/1985 | Hoyle . | |
| 4,547,920 | 10/1985 | Hulsebusch et al. . | |
| 4,700,634 | 10/1987 | Mills et al. . | |
| 4,717,024 | 1/1988 | Djezovic . | |
| 4,957,235 | 9/1990 | Beno et al. | 108/25 X |
| 5,000,327 | 3/1991 | Kincheloe . | |
| 5,090,334 | 2/1992 | Sutton . | |
| 5,222,764 | 6/1993 | Dyer . | |
| 5,265,735 | 11/1993 | Hassel et al. . | |
| 5,297,814 | 3/1994 | Peters . | |
| 5,487,466 | 1/1996 | Robson . | |
| 5,516,151 | 5/1996 | Mund et al. . | |
| 5,680,973 | 10/1997 | Vulpitta et al. | 108/43 X |
| 5,692,815 | 12/1997 | Murphy | 108/43 X |
| 5,823,574 | 10/1998 | Sullins et al. . | |

OTHER PUBLICATIONS

Heritage Products Advertisement, Book Buddy.

Levenger Tools for Serious Readers, Early Summer 1993, Readers Pillow, #AF050, p. 3.

*Primary Examiner*—Jose V. Chen

*Attorney, Agent, or Firm*—Sidley & Austin

[57] ABSTRACT

A lap desk (10) is disclosed which has a base (12) which mounts a lid (14) through hinges (16, 18). The base (12), on three sides, defines tray attachment sections (40) for external attachment of one or more trays (38) to carry accessories. The lid (14) has cutout sections (50, 52, 54) which permit the lid to be moved between the open and closed position and used in the closed position with the trays (38) supported on the base (12). The base (12) can be provided with a storage lip (64) which receives the trays within the compartment (32) within the base (12) for storage.

13 Claims, 8 Drawing Sheets

FIG. 2
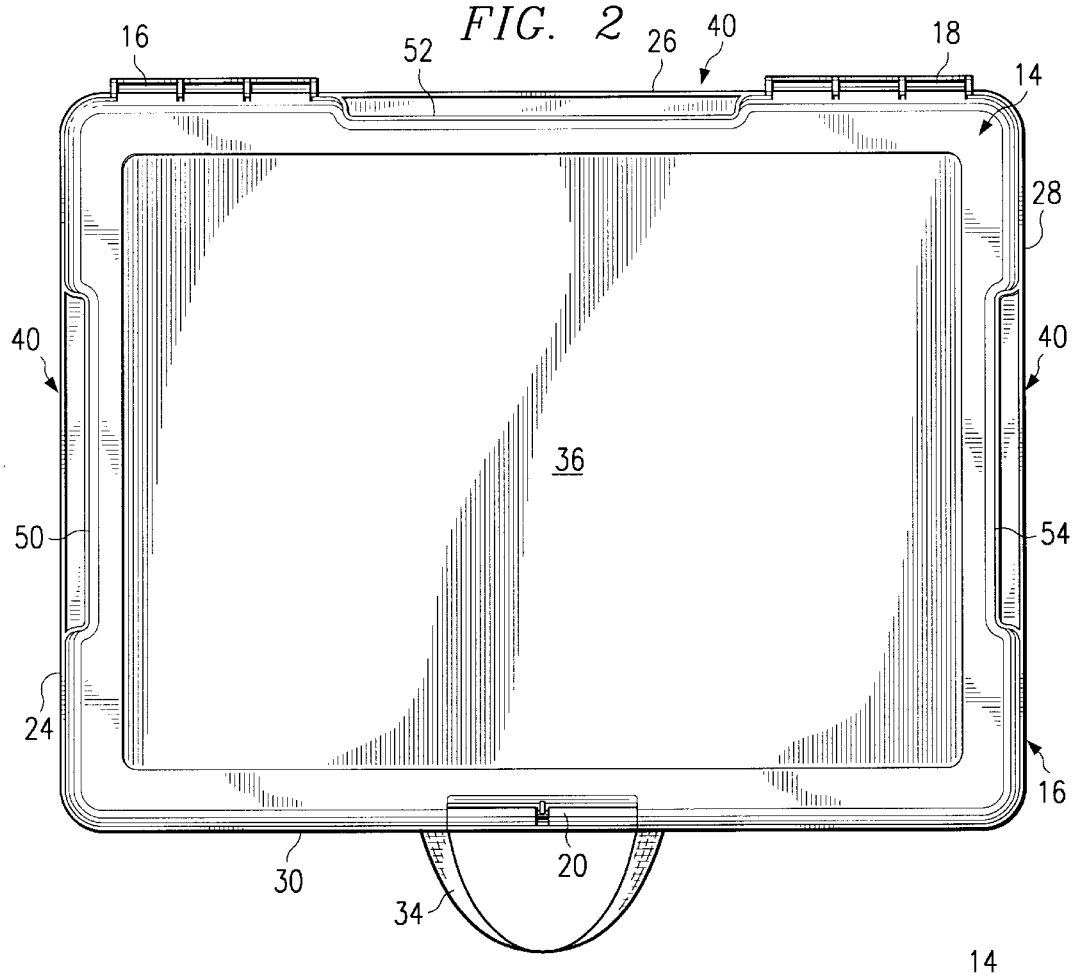
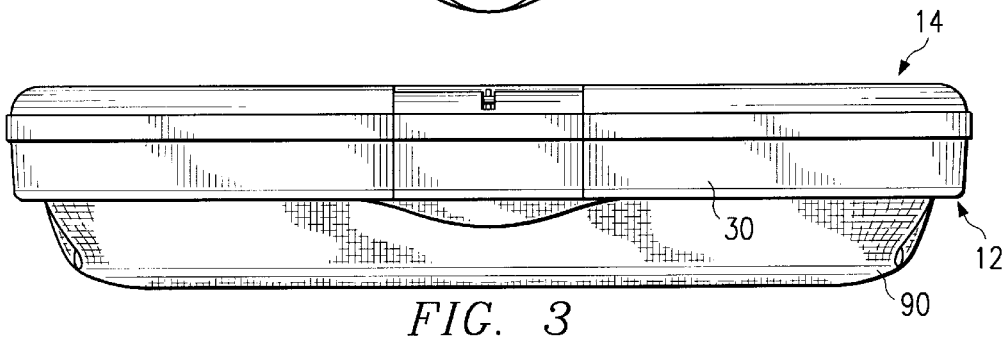
FIG. 3
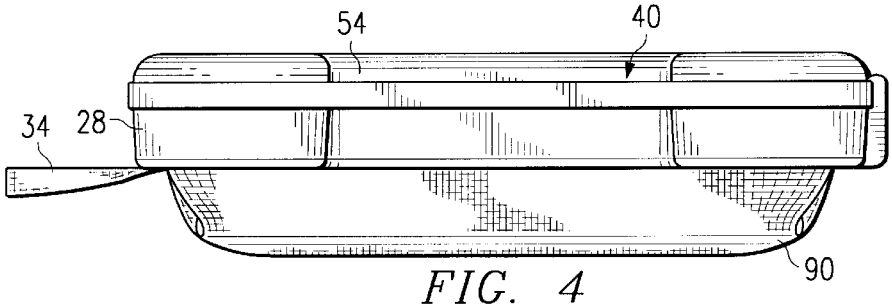
FIG. 4

LAP DESK WITH EXTERNAL TRAYS AND HINGED TOP

TECHNICAL FIELD OF THE INVENTION

This invention relates a lap desk for use in writing and the like while the desk rests in the lap.

BACKGROUND OF THE INVENTION

The lap desk has been found to be a very convenient and useful device for both adults and children. A typical lap desk will have a hard upper writing surface and a lower cushion surface to support the lap desk in the lap of the person using it.

It is often helpful to have supplies accompany the lap desk to facilitate its use, such as pencils, pens, erasers, paper clips and the like. A need exists for a lap desk design which facilitates the convenience of these accessories while maintaining full function as a lap desk.

SUMMARY OF THE INVENTION

A lap desk is provided which has a base with at least one edge and a lid mounted to the base for movement between an open position and a closed position. At least one tray is provided which has at least one side. The edge of the base defines a first attachment member while the side of the tray defines a second attachment member. The first and second attachment members cooperate to support the tray at the edge of the base while the lid is in the open and closed positions.

In accordance with another aspect of the present invention, the lid has at least one cut out section to accommodate the first and second attachment members. The first attachment member of the base can be a lip while the second attachment member of the tray can be a hook. The hook can be defined by a pair of downwardly directed hooks and an upwardly directed hook. The lip on the base can have an upwardly directed lip and a downwardly directed lip.

In accordance with yet another aspect of the present invention, the base can define a compartment to store the tray therein. The lid closes over the compartment in the closed position. The base can have a storage lip defined in the compartment to receive the tray to store the tray within the compartment. Preferably, the base has at least three edges with first attachment members. One edge can be between hinges mounting the lid to the base.

BRIEF DESCRIPTION OF THE DRAWINGS

For a more complete understanding of the present invention, and for further advantages thereof, reference is now made to the following description of the preferred embodiment taken in conjunction with the company drawings, in which:

FIG. 2 is a top view of the lap desk;

FIG. 3 is a front view of the lap desk;

FIG. 4 is a side view of the lap desk;

DETAILED DESCRIPTION OF THE INVENTION

Figure 13:
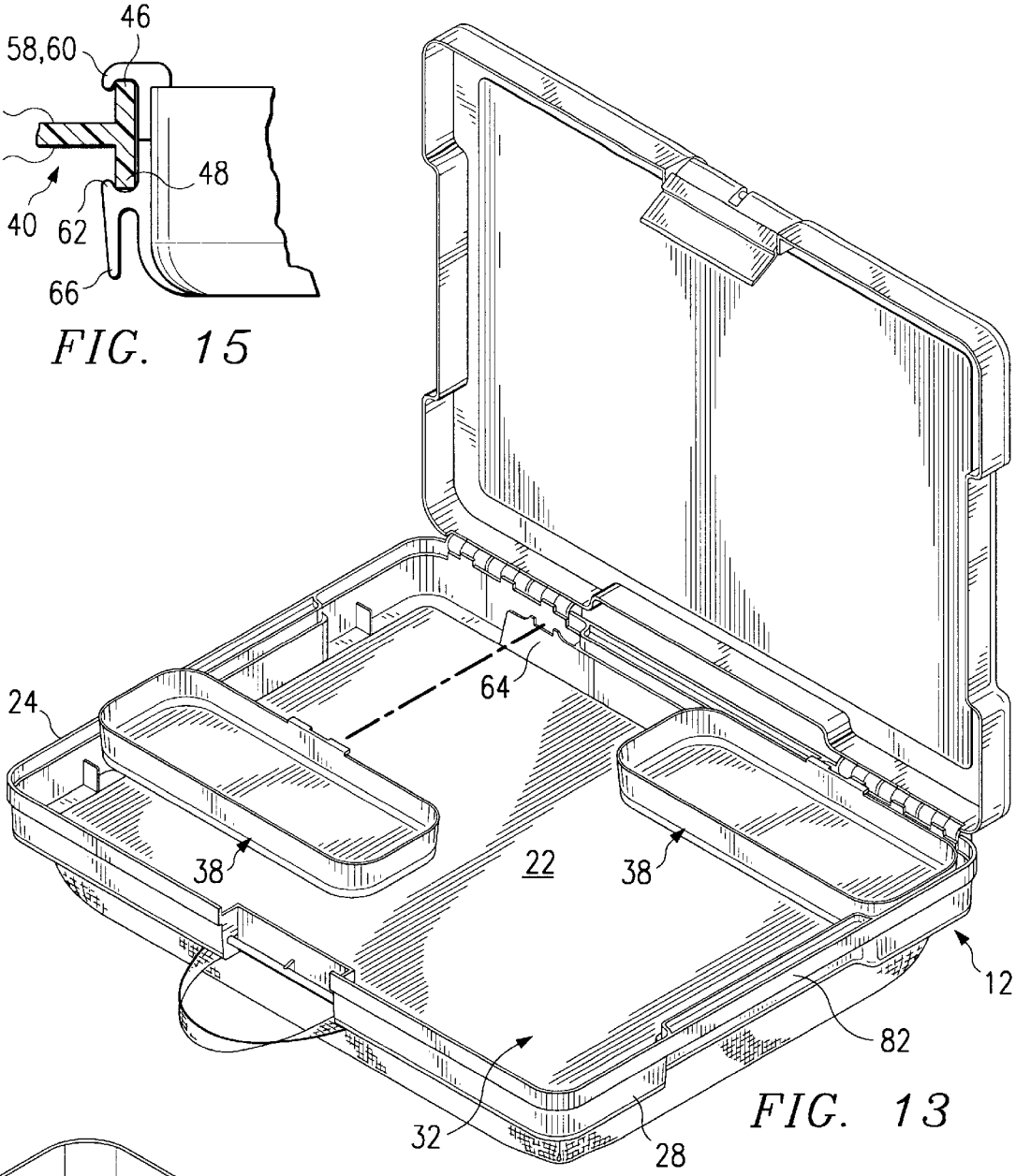
FIG. 13 is a perspective view of the lap desk with the lid open illustrating the mounting of the trays therein.

With reference now to the figures, and in particular to FIGS. 1–16, a lap desk 10 is illustrated which forms a first embodiment of the present invention. The lap desk 10 includes a base 12 and a lid 14. The lid 14 is secured to the base at a pair of hinges 16 and 18 which hingeably connect the lid to the base. The lid 14 can be moved between a closed position, as seen in FIGS. 1–6, and an open position, as seen in FIG. 13, about the hinges 16 and 18. A latch 20 is mounted on the lid 14 on the edge opposite the hinges 16 and 18 to latch the lid 14 in the closed position.

The base 12 has a bottom 22 and sidewalls 24, 26, 28 and 30 extending upwardly therefrom to define a compartment 32 within the base (FIG. 13). A cushion 90 is secured to bottom 22 to allow the desk 10 to comfortably be supported on the lap. The compartment 32 provides space for storage of accessories for use with the lap desk 10, such as pencils, pens, paper, scissors, rules, erasers and the like. With the lid 14 closed, the compartment 32 is covered by the lid 14 which prevents accessories from falling out of the compartment when the lap desk 10 is carried by handle 34 or stored in a vertical position. With the lid 14 in the closed position it defines a writing surface 36 which can be used for writing or other useful functions.

Figure 1:
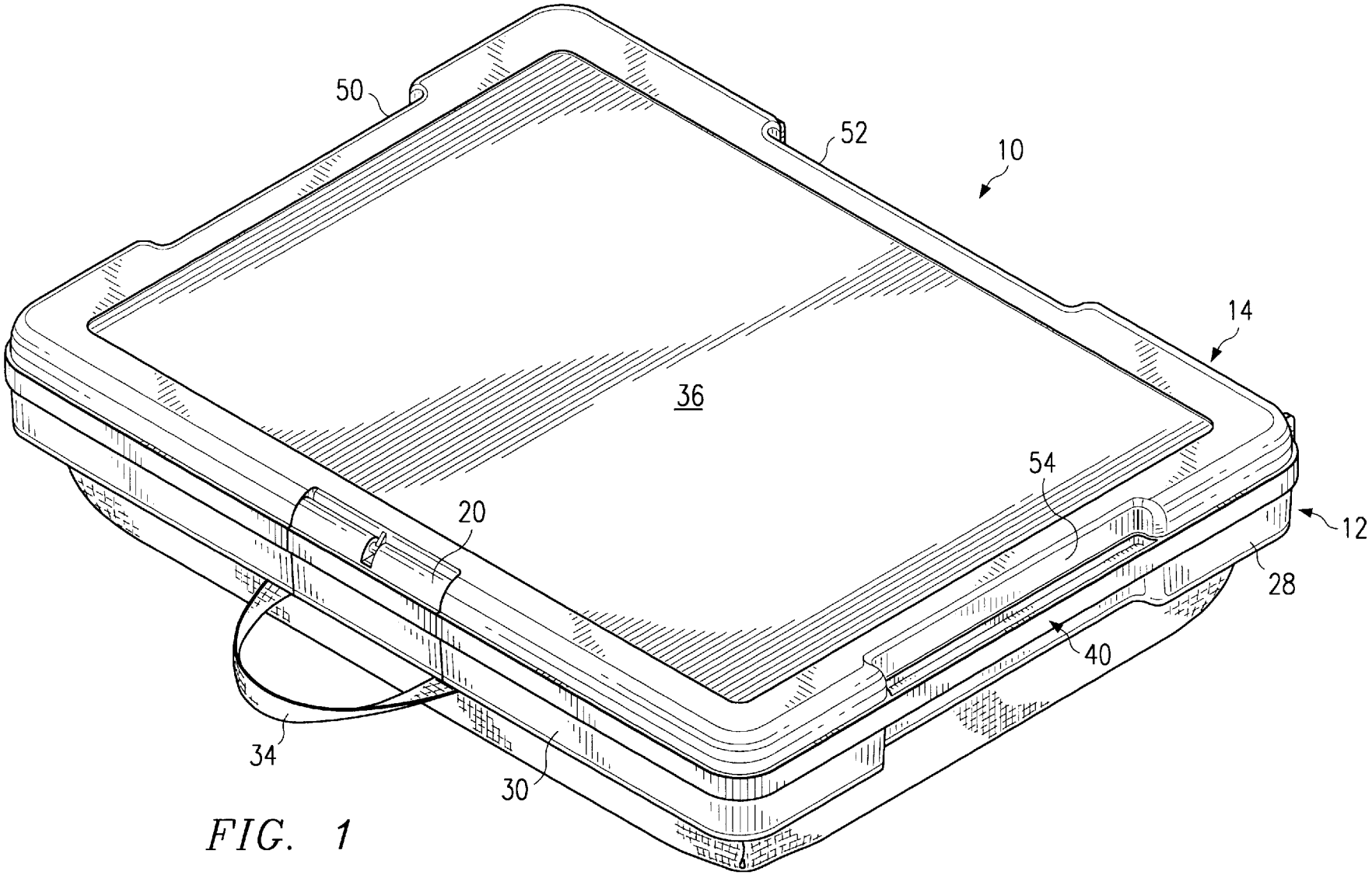
FIG. 1 is a perspective view of a lap desk forming a first embodiment of the present invention.
Figure 5:
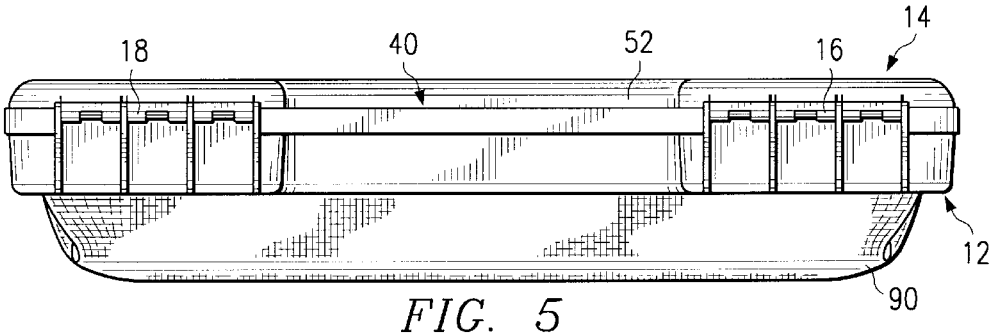
FIG. 5 is a back view of the lap desk.
Figure 6:
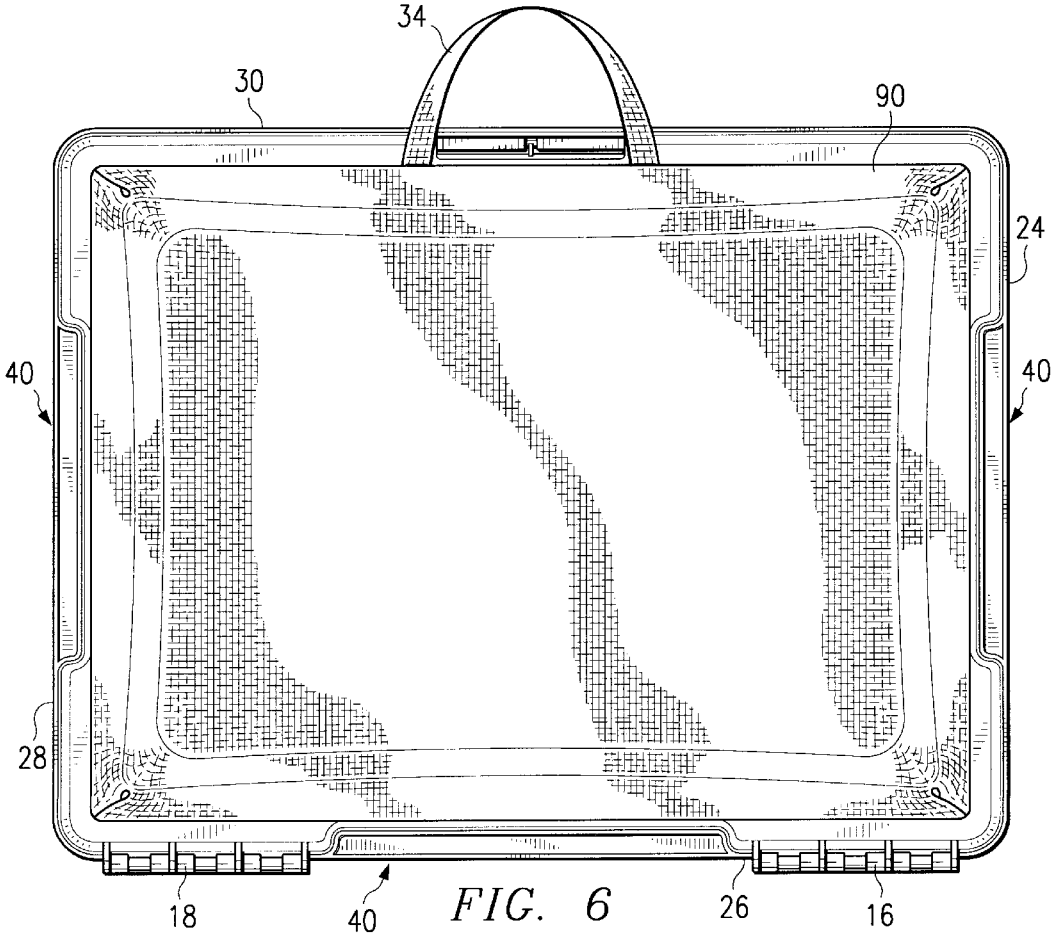
FIG. 6 is a bottom view of the lap desk.
Figure 7:
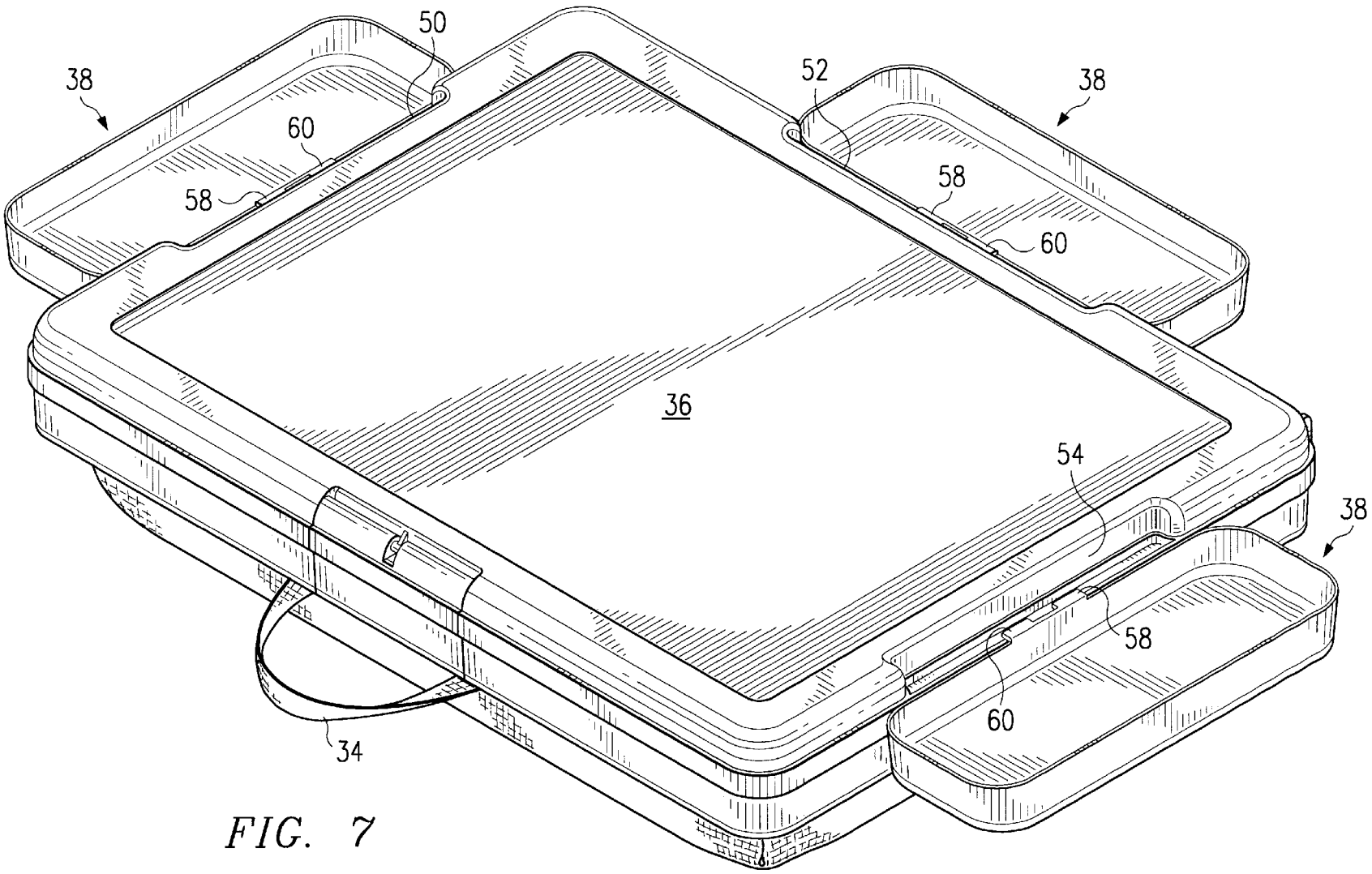
FIG. 7 is a perspective view of the lap desk showing trays mounted thereon.
Figure 8:
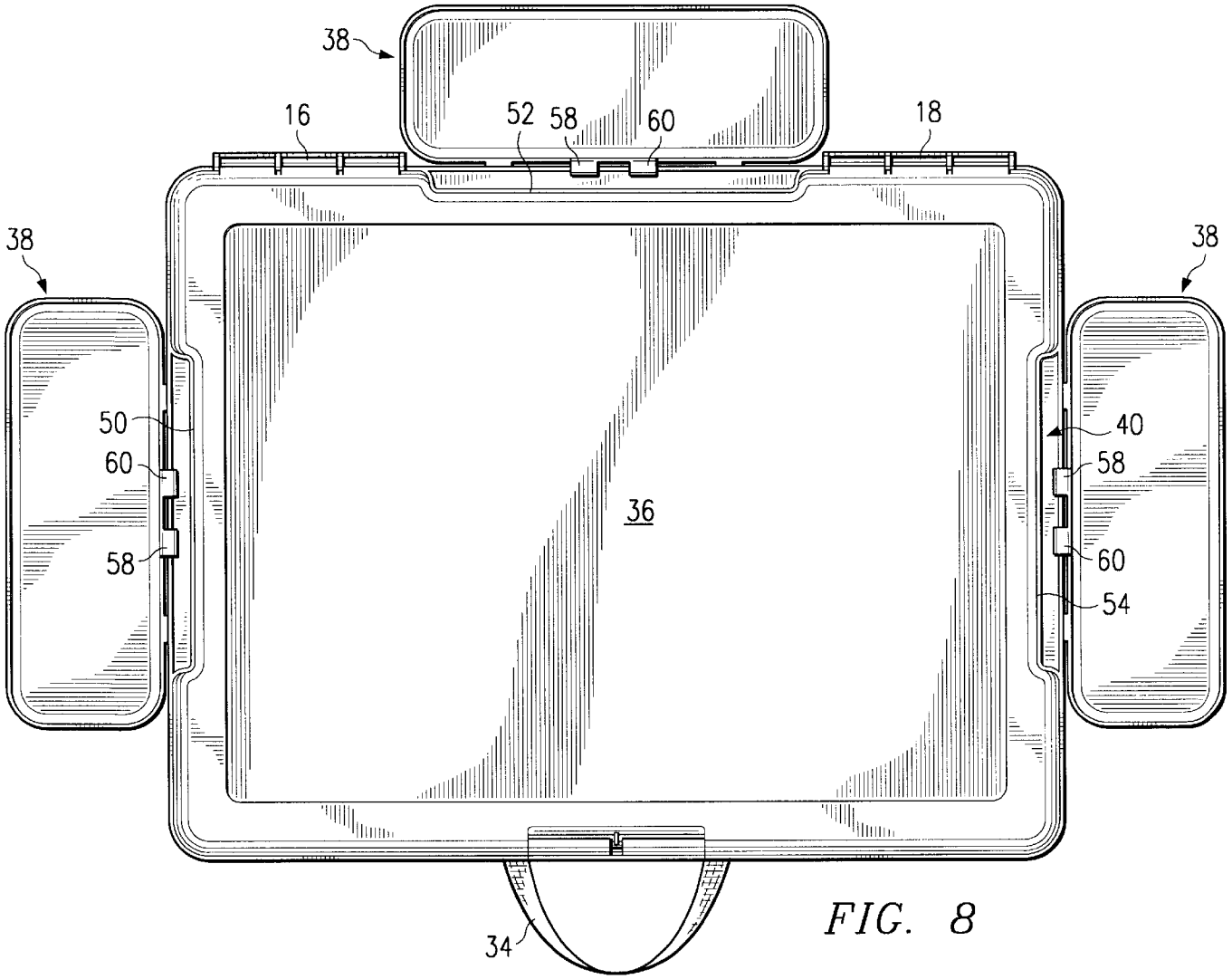
FIG. 8 is a top view of the lap desk showing trays mounted thereon.
Figure 9:
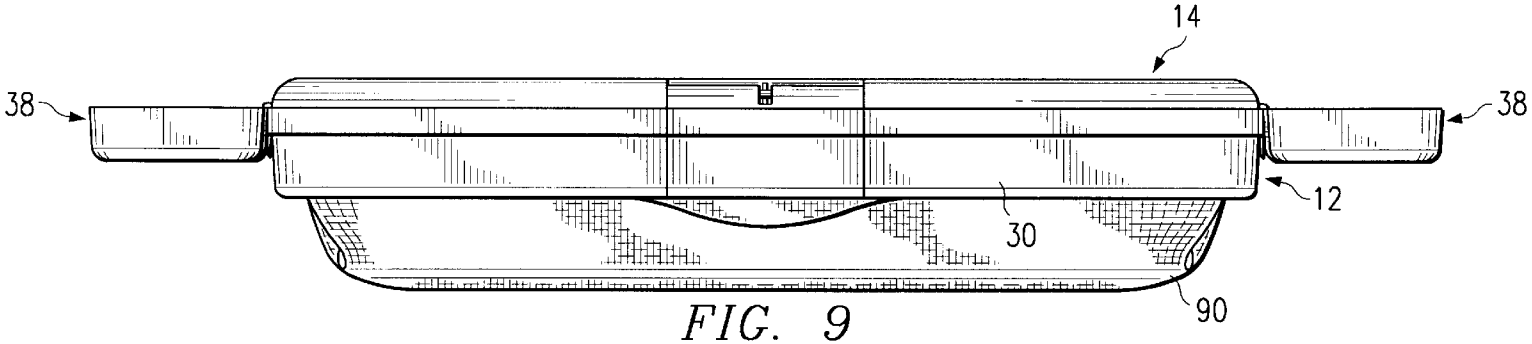
FIG. 9 is a front view of the lap desk showing trays mounted thereon.
Figure 10:
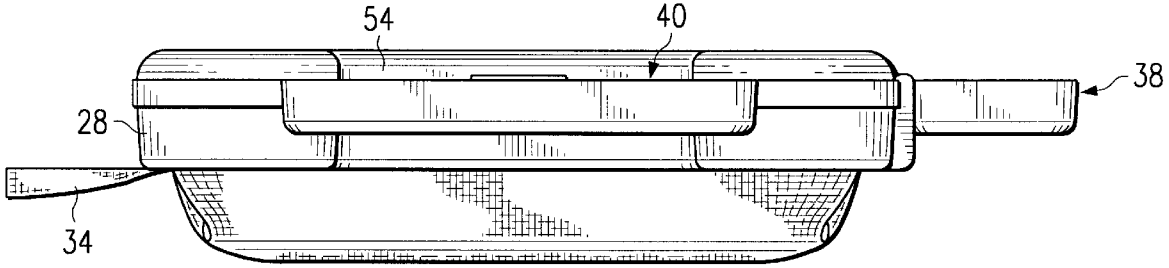
FIG. 10 is a side view of the lap desk showing trays mounted thereon.
Figure 11:
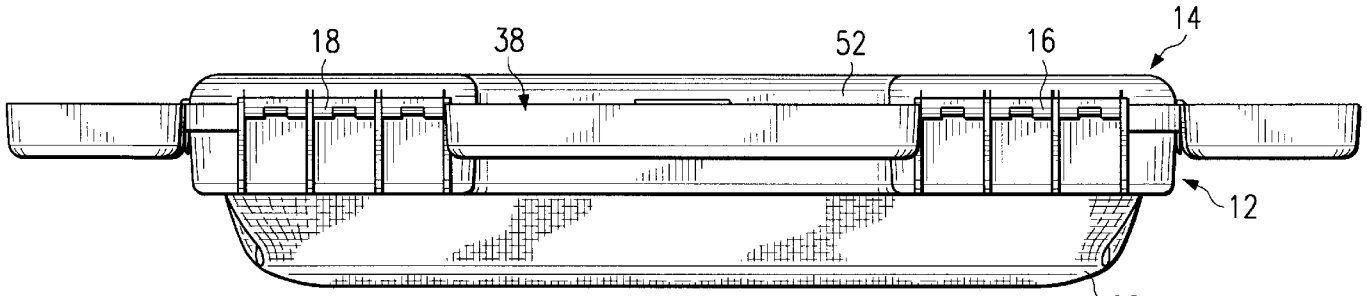
FIG. 11 is a back view of the lap desk showing trays mounted thereon.
Figure 12:
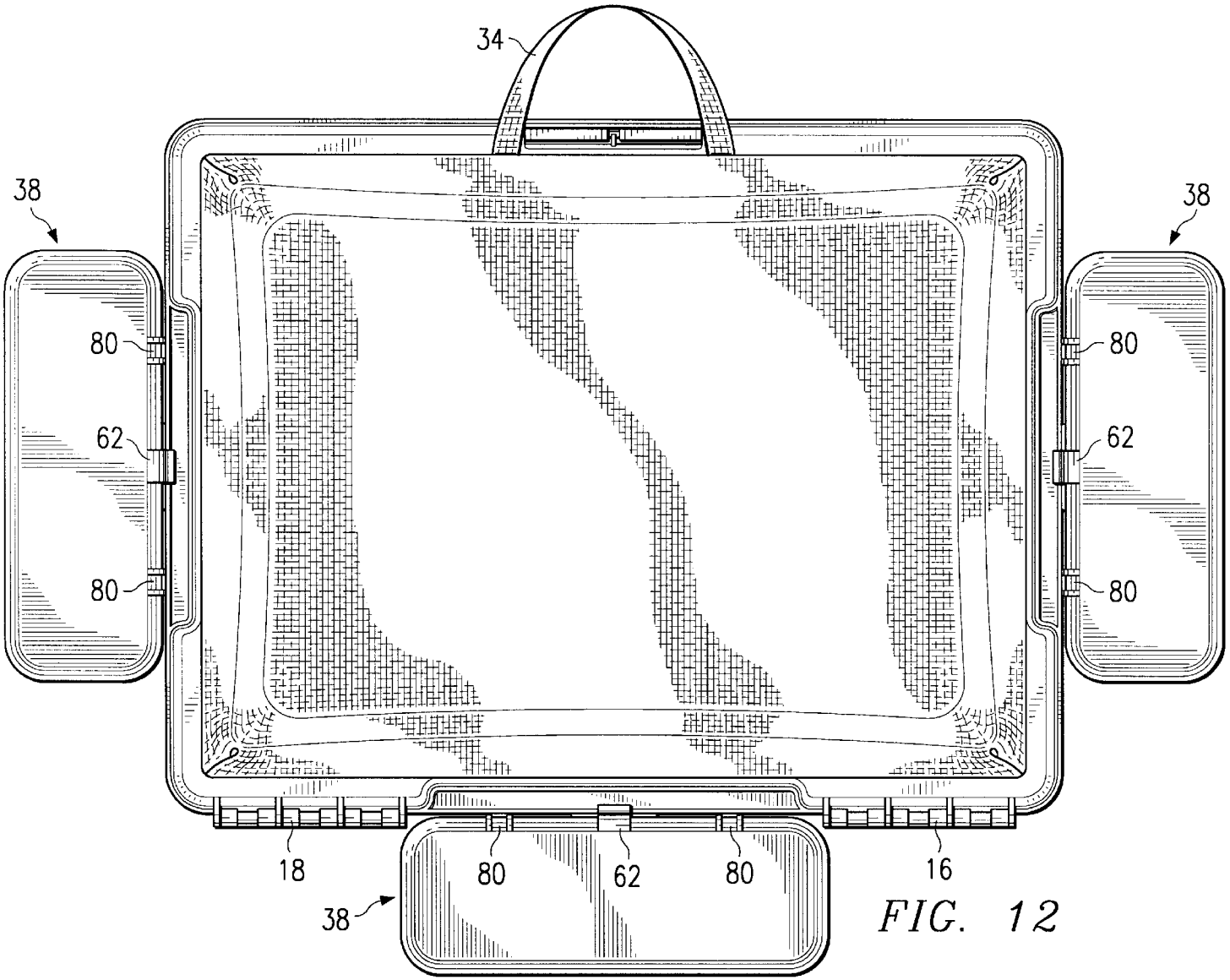
FIG. 12 is a bottom view of the lap desk showing trays mounted thereon.
Figure 15:
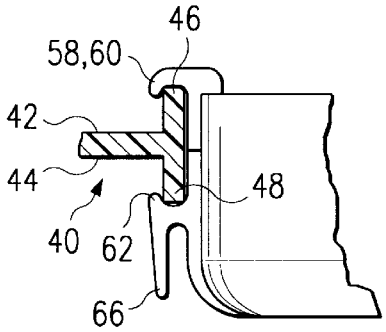
FIG. 15 is a cross-sectional view of the attachment of the tray to the lap desk.
Figure 14:
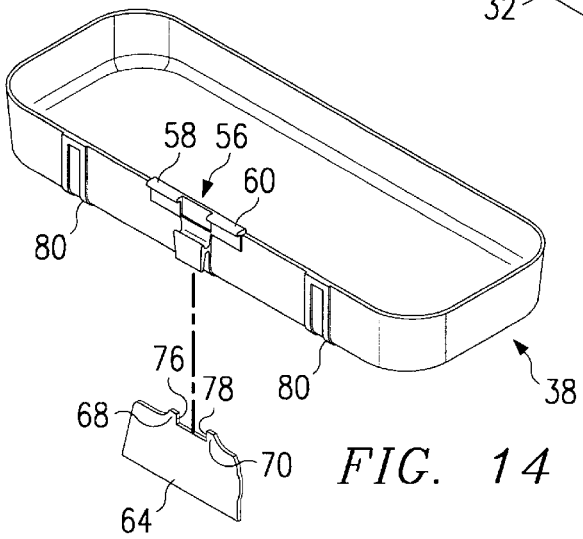
FIG. 14 is a perspective of a tray forming part of the lap desk.

The lap desk 10 is provided with trays 38 for carrying accessories (FIG. 14). The trays can be mounted on the side walls of the base 12, as illustrated in FIGS. 7–12, even with the lid in the closed position for writing. On at least three of the side walls of the base 12 tray attachment sections 40 are defined. Tray attachment sections 40 define upper and lower horizontal portions 42 and 44 which end in upwardly and downwardly directed lips 46 and 48, respectively (FIG. 15). It should be noted that a tray attachment section 40 is formed on the base 12 between the hinges 16 and 18. The lid 14 has cutout sections 50, 52 and 54 which insure the tray attachment sections 40 are exposed to receive a tray when the lid is in the open position, the closed position, or moving between the open and closed positions.

Each tray 38 has a hook portion 56 which include a pair of downwardly directed hooks 58 and 60 (FIGS. 14 and 15) and at least one upwardly directed hook 62. The tray 38 is preferably formed of a plastic, and the hooks 58, 60 and 62 have some resiliency so that the hooks can be deformed about the lips 46 and 48 of a tray attachment section 40 to secure the tray to the base 12 as seen in FIG. 15. Typically, the hooks 58 and 60 will be hooked over the lip 46 and the tray will then be swung downwardly so that the hook 62 is deformed sufficiently to snap over the lip 48 to hold the tray 38 in place on the base 12. Also, as seen in FIG. 14, the tray has spacers 80 molded into the side of the tray mounting hook portion 56 to bear against the outer surface 82 of the side walls. The design of the tray 38 and hook portion 56 is such that it will not interfere with the lid 14 as the lid moves between the open and closed positions. It should be noted that the tray attachment sections 40, including lips 46 and 48, extend a considerable distance along the side walls 24, 26 and 28. This permits the trays 38 to be positioned anywhere along the attachment sections 40 by simply attaching it to a portion of the section where desired, or sliding it along the section to the position desired. Preferably, at least two trays 38 are provided with the lap desk 10, allowing the trays to be mounted on the sides 24 and 28 of the base between the hinges and latch or on the side 26 including the hinges, as illustrated in FIGS. 7–12. As can be understood, various accessories can be held in the trays 38 while the lid 14 is closed and the writing surface 36 is in use.

Preferably, as seen in FIGS. 13 and 14, the base 12 will also define storage lips 64 which extends upwardly from the bottom 22 within the confines of the sides 24–30, proximate hinges 16 and 18. Each storage lip 64 can be used to store a tray 38 within the compartment 30 when the lap desk 10 is not in use. The hook 62 on each tray 38 is preferably provided with a downwardly extending storage hook 66 integral therewith which fits over the storage lip 64, as seen in FIGS. 13 and 14, to store the tray 38 within the compartment 32. The storage lip 64 preferably has upwardly extending portions 68 and 70 to prevent the tray 38 from sliding along the storage lip 64 when the tray is stored. The inner edges 76 and 78 of portions 68 and 70 will limit movement of the tray. Also, the storage lip 64 preferably has at least two positions for storage of trays 38 side by side. The length of the trays is such that two trays side by side extend substantially the entire width of the compartment 32, adding to the stability of the trays in storage.

Although the present invention has been described with respect to a specific preferred embodiment thereof, various changes and modifications may be suggested to one skilled in the art. It is intended that the present invention encompass such changes and modifications as fall within the scope of the appended claims.

We claim:

1. A lap desk, comprising:

a base having at least one edge, the edge defining a first attachment member;

a lid mounted to the base for motion between an open position and a closed position; and at least one tray having a side defining a second attachment member, the first and second attachment members cooperating to support the tray at the edge of the base when the lid is in the open and closed positions wherein the lid has at least one cutout section at said edge of said base when the lid is in the closed position.

2. The lap desk of claim 1 wherein said first attachment member on said base includes a lip, said second attachment member on said tray including a hook.

3. The lap desk of claim 2 wherein the first attachment member of the base has a double lip, said second attachment member of said tray having double hooks.

4. The lap desk of claim 1 wherein the base has a compartment to store said tray, the lid closing the compartment in the closed position.

5. The lap desk of claim 1 wherein the base has three edges, each edge defining a first attachment member.

6. The base of claim 5 wherein at least one of said edges is between a first and second hinge, said first and second hinges hingeably mounting the lid to the base.

7. The lap desk of claim 1 wherein said second attachment member on said tray includes a pair of upper, downwardly directed hooks and at least one lower, upwardly extending hook.

8. The lap desk of claim 1 wherein the base further has a first storage attachment member, said first storage attachment member and said second attachment member cooperating to secure the tray to the base at the first storage attachment member.

9. The lap desk of claim 1 wherein said first attachment member defines upper and lower horizontal surfaces and upwardly and downwardly extending lips.

10. A lap desk, comprising:

a base having a bottom and four sides, three of said sides defining a tray attachment section, each tray attachment section defining an upper horizontal surface extending to an upwardly directed lip and a lower horizontal surface extending to a downwardly directed lip;

a lid hingeably mounted on the base by a hinge for pivotal motion between an open position and a closed position, one of said tray attachment sections lying between first and second portions of said hinge; and at least one tray having a side defining a hook portion, said hook portion including at least one downwardly directed hook and at least one upwardly directed hook for hooking the tray onto one of said tray attachment sections;

wherein the lid has cutout sections at each said tray attachment section when the lid is in the closed position.

11. The lap desk of claim 10 wherein the edge of said base without a tray attachment section defines a portion to latch the lid in the closed position.

12. The lap desk of Claim 10 wherein the bottom and sides of said base define a compartment, a storage attachment section extending upwardly from the bottom within the compartment, said tray being engaged with said storage attachment section to store the tray within the compartment.

13. The lap desk of claim 10 having at least two trays.

* * * * *